US006016590A

United States Patent [19]

Malone

[11] Patent Number: 6,016,590

[45] Date of Patent: Jan. 25, 2000

[54] LACE WRAPS

[76] Inventor: Larry D. Malone, 1110 Village Green Dr., Austin, Tex. 78753

[21] Appl. No.: 09/244,514

[22] Filed: Feb. 4, 1999

[51] Int. Cl.[7] ..... A43B 11/00; F16G 11/00

[52] U.S. Cl. ..... 24/712.1; 24/712.2; 24/712.3; 24/442

[58] Field of Search ..... 24/712.1, 712, 24/712.2, 712.3, 713.9, 306, 442, 17 AP, 17 B, 17 R, 16 R, DIG. 11

[56] References Cited

U.S. PATENT DOCUMENTS

| | | | |
|---|---|---|---|
| 3,525,376 | 8/1970 | Muhlhauser | 24/442 |
| 4,291,439 | 9/1981 | Riti | 24/712.2 |
| 4,553,293 | 11/1985 | Blum | 24/712.2 |
| 4,571,854 | 2/1986 | Edens . | |
| 4,712,766 | 12/1987 | Ehrenhalt | 24/16 R |
| 4,780,936 | 11/1988 | Brecher | 24/712.2 |
| 4,815,172 | 3/1989 | Ward | 24/442 |
| 4,937,920 | 7/1990 | Tsai | 24/442 |
| 4,939,824 | 7/1990 | Reed | 24/633 |
| 4,999,888 | 3/1991 | Miller . | |
| 5,022,127 | 6/1991 | Ang . | |
| 5,165,190 | 11/1992 | Smyth . | |
| 5,170,573 | 12/1992 | Clinch | 24/712.2 |
| 5,778,500 | 7/1998 | Illingworth | 24/16 R |

*Primary Examiner*—Victor N. Sakran
*Attorney, Agent, or Firm*—Patent & Trademark Services; Joseph H. McGlynn

[57] ABSTRACT

A retainer for knotted shoe laces that surrounds a knotted or tied shoe lace and prevents the lace from coming loose.

4 Claims, 1 Drawing Sheet

FIG. 1
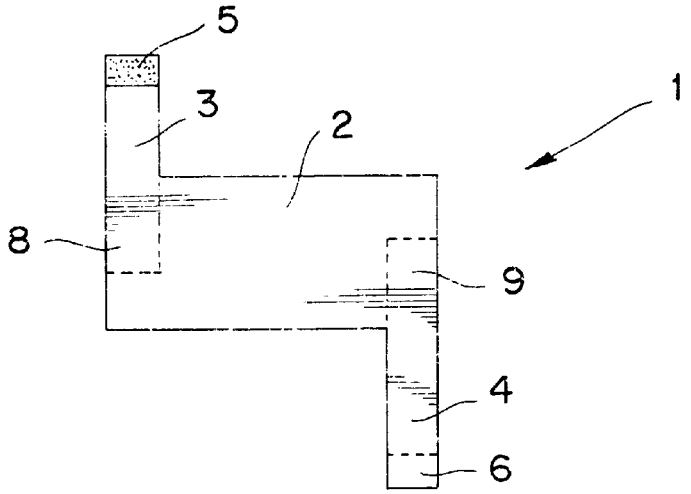
FIG. 2
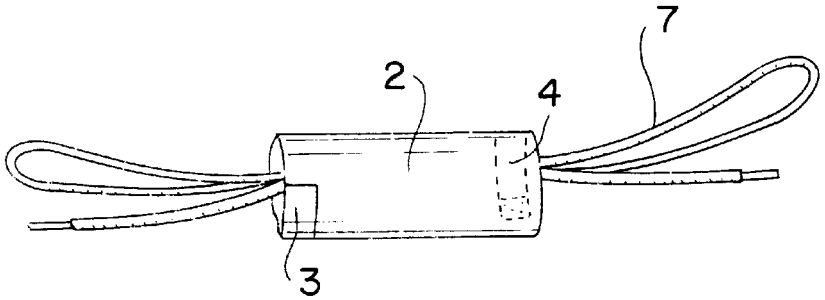
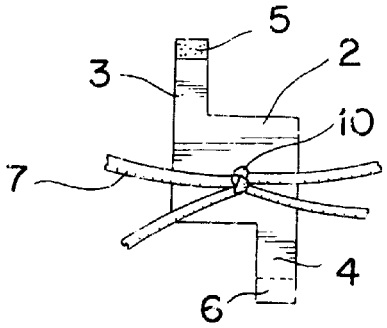
FIG. 3

LACE WRAPS

BACKGROUND OF THE INVENTION

This invention relates, in general, to shoe lace retainers, and, in particular, to shoe lace retainers for any type of shoes having laces.

DESCRIPTION OF THE PRIOR ART

In the prior art various types of lace retainers have been proposed. For example, U.S. Pat. No. 4,571,854 to Edens discloses a knot latch device with a plurality of mating hook and loop elements which fasten the device around a knotted shoe lace.

U.S. Pat. No. 4,999,888 to Miller discloses a shoelace retainer which is a flexible, elongated strap having a plurality of loop elements on an opposite surface to secure a knotted shoe lace.

U.S. Pat. No. 5,022,127 to Ang discloses a shoelace locking device with holes through which the laces can be threaded to attach it to a shoe.

U.S. Pat. No. 5,165,190 to Smyth discloses a laces shoe fastener, one part of which attaches to the shoe and the other part is secured to the first part by hook and loop fasteners.

SUMMARY OF THE INVENTION

The present invention is a retainer for knotted shoe laces that surrounds a knotted or tied shoe lace and prevents the lace from coming loose.

It is an object of the present invention to provide a retainer for knotted shoelaces.

It is an object of the present invention to provide a retainer for knotted shoelaces that is easy to apply.

It is an object of the present invention to provide a retainer for knotted shoelaces that can be used with any type of shoes which have laces.

These and other objects and advantages of the present invention will be fully apparent from the following description, when taken in connection with the annexed drawings.

BRIEF DESCRIPTION OF THE DRAWINGS

FIG. 1 is a plan view of the present invention.

FIG. 2 is a view showing the retainer of the present invention in position around a knotted shoe lace.

FIG. 3 is a view of the retainer of the present invention around a knotted shoe lace before the retainer is applied to the shoelace.

DESCRIPTION OF THE PREFERRED EMBODIMENT

Referring now to the drawings in greater detail, FIG. 1 shows the shoe lace wrap 1 of the present invention. The wrap comprises a body portion 2, which can be made from any type of material such as, but not limited to, canvas or plastic. Also, it should be noted that the body 2 is shown as being rectangular, however, the shape is not critical and other shapes such as circular could be used. In addition, the straps 3, 4 are shown in FIG. 1 as being unitary with the body 2, but they could also be made as separate pieces and made integral with the body 2 such as by sewing or gluing.

Attached to the body 2 are a pair of straps 3, 4 which can be made from the same material as the body 2 or a different material. The straps 3, 4 extend away from the body on opposite sides of the body as shown in FIG. 1. The end of the strap 3 has a hook and loop type fastener 5 attached thereto in any conventional manner. The end of the strap 4 has a hook and loop type fastener 6 attached thereto in any conventional manner. The body 2 has complimentary hook and loop fasteners 8, 9 attached thereto in any conventional manner, which will cooperate with the fasteners 5, 6 to hold the body around the knotted laces 7 as shown in FIG. 2.

In order to attach the lace wrap 1 the wrap is first placed under the area where the knot 10 will be when the laces are tied (see FIG. 3). Then the shoe lace 7 will be tied in the normal manner. Once the shoe lace is tied, the lace wrap 1 is rolled into the shape shown in FIG. 2, and secured by means of the straps 3, 4 and the fasteners 5, 6 on the straps engaging the fasteners 8, 9 on the body 2.

Once the wrap 1 is secured around the laces 7 the knot, it will be less likely that the knot will come untied. Also, since the straps 3, 4 extend in opposite directions around the body 2, it is unlikely that a person might accidentally catch both of the straps 3, 4 on an obstacle and accidentally pull the wrap 1 loose. That is if a person accidentally snags one of the straps 3, 4 on an obstacle as they are walking, the obstacle might pull one of the straps loose, however, since the straps extend in opposite directions, both straps will not be pulled loose. This means that the wrap 1 will remain, at least partially attached to the knotted shoelace and this will prevent the knot from being pulled loose.

Although the Lace Wraps and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A shoelace wrap for preventing a knotted shoelace from being accidentally untied, said shoelace wrap comprising:

a body portion having opposing surfaces and at least two opposing sides, said body portion having a pair of detachable straps attached thereto along a portion of said at least two opposing sides, one of said pair of straps extending in a first direction away from said body portion, and another of said pair of straps extending in a second direction away from said body portion, fastening means on said pair of straps, and cooperating fastening means on said body portion for securing said body portion around tied shoelaces.

2. The shoelace wrap as claimed in claim 1, wherein said first direction is opposite from said second direction.

3. The shoelace wrap as claimed in claim 1, wherein said fastening means on said pair of straps and said cooperating fastening means on said body portion are hook and loop type fasteners.

4. The shoelace wrap as claimed in claim 1, wherein said body portion is rectangular and said pair of straps are unitary with said body portion.

* * * * *